US006986565B2

(12) United States Patent
Watanabe et al.

(10) Patent No.: US 6,986,565 B2
(45) Date of Patent: Jan. 17, 2006

(54) INKJET HEAD FOR INKJET PRINTING APPARATUS HAVING PRESSURE CHAMBERS AND ACTUATOR UNIT

(75) Inventors: Hidetoshi Watanabe, Aichi-ken (JP); Atsuo Sakaida, Gifu-ken (JP); Atsushi Hirota, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/305,979

(22) Filed: Nov. 29, 2002

(65) Prior Publication Data

US 2003/0103118 A1 Jun. 5, 2003

(30) Foreign Application Priority Data

Nov. 30, 2001 (JP) ..... 2001-365497

(51) Int. Cl.
*B41J 2/045* (2006.01)

(52) U.S. Cl. ..... 347/71

(58) Field of Classification Search ..... 347/68, 347/70–72; 29/25.35, 890.1; 310/328
See application file for complete search history.

(56) References Cited

U.S. PATENT DOCUMENTS 5,402,159 A 3/1995 Takahashi et al.
5,758,396 A 6/1998 Jeon et al.
6,079,820 A 6/2000 Dijksman et al.
6,174,051 B1 * 1/2001 Sakaida ..... 347/72
6,223,405 B1 5/2001 Oikawa et al.
2002/0071008 A1 * 6/2002 Hashizume et al. ..... 347/70

FOREIGN PATENT DOCUMENTS

JP A 4-341852 11/1992

* cited by examiner

*Primary Examiner*—Stephen Meier
*Assistant Examiner*—An H. Do
(74) *Attorney, Agent, or Firm*—Oliff & Berridge, PLC

(57) ABSTRACT

An inkjet head is provided with a plurality of pressure chambers, each of which is configured such that an end thereof is connected to a discharging nozzle and the other end is connected to an ink supplier, and an actuator unit for the plurality of pressure chambers. The actuator unit is formed to be a continuous planar layer including at least one inactive layer arranged on a pressure chamber side and at least one active layer arranged on a side opposite to the pressure chamber side with respect to the inactive layer, the planar layer covering the plurality of pressure chambers. The at least one active layer is sandwiched between a common electrode and a plurality of driving electrodes arranged at positions corresponding to the plurality of pressure chambers. The continuous planar layer includes a plurality of active layers or a plurality of inactive layers.

21 Claims, 10 Drawing Sheets

INKJET HEAD FOR INKJET PRINTING APPARATUS HAVING PRESSURE CHAMBERS AND ACTUATOR UNIT

BACKGROUND OF THE INVENTION

The present invention relates to an inkjet head for an inkjet printing apparatus.

Recently, inkjet printing apparatuses are widely used. An inkjet head (i.e., a printing head) employed in an inkjet printing apparatus is configured such that ink is supplied from an ink tank into manifolds and distributed to a plurality of pressure chambers defined in the inkjet head. By selectively applying pressure to the pressure chambers, ink is selectively ejected through the nozzles, which are defined corresponding to the pressure chambers, respectively. For selectively applying pressure to respective pressure chambers, an actuator unit composed of laminated sheets of piezoelectric ceramic is widely used.

An example of such an inkjet head is disclosed in U.S. Pat. No. 5,402,159, teachings of which are incorporated herein by reference. The above-described patent discloses an inkjet head which includes an actuator unit having ceramic layers which are consecutive laminated planes extending over a plurality of pressure chambers. In the inkjet head of the above-mentioned patent, the piezoelectric ceramic layers of the actuator unit generally include active layers and inactive layers. The active layers are located at the pressure chamber side and sandwiched between a common electrode kept at a ground potential and driving electrodes (individual electrodes) respectively located at places corresponding to the pressure chambers. One inactive layer is located on a pressure chamber side and another inactive layer is located on a side opposite to the pressure chambers. By selectively controlling the potential of the driving electrodes to be different from that of the common electrodes, the active layers expand/contract in the stacked direction of the layers in accordance with a piezoelectric longitudinal effect. With this expansion/contraction of the active layers, the volume within the corresponding pressure chambers varies, thereby ink being selectively ejected from the pressure chambers. The inactive layers deform very little and serve to support the active layers from above so that the active layers effectively expand/contract in the stacked direction of the layers.

Recently, there is a great demand for highly integrated pressure chambers. However, the inkjet head of the type as described in the above-mentioned patent is insufficient to meet such a demand.

SUMMARY OF THE INVENTION

In view of the above, the present invention is advantageous in that an inkjet head having highly integrated pressure chambers is provided.

According to an aspect of the invention, there is provided an inkjet head, which is provided with a plurality of pressure chambers, each of which being configured such that an end thereof is connected to a discharging nozzle and the other and is connected to an ink supplier, and an actuator unit for the plurality of pressure chambers. With this configuration, the actuator unit is formed to be a continuous planar layer including at least one inactive layer, which is formed of piezoelectric material, arranged on a pressure chamber side and at least one active layer, which is formed of piezoelectric material, arranged on a side opposite to the pressure chamber side with respect to the inactive layer. The planar layer is arranged to cover the plurality of pressure chambers. The at least one active layer is sandwiched between a common electrode and a plurality of driving electrodes arranged at positions corresponding to the plurality of pressure chambers. The continuous planar layer includes a plurality of the at least one active layers and/or a plurality of the at least one inactive layers.

In a particular case, when the driving electrodes is set to have potential different from the potential of the common electrode, the at least one active layers deforms in accordance with piezoelectric transverse effect, a unimorph effect being generated by the deformation of the active layers in association with the at least one inactive layer to vary a volume of each of the pressure chambers.

Optionally, the common electrode may be kept to a ground potential.

Optionally, an electrode arranged farthest from the pressure chamber may be configured to be the thinnest electrode among the common electrode and the plurality of driving electrodes. Such an electrode may be formed by vapor deposition.

Optionally, an electrode closest to the pressure chambers is the common electrode.

Further optionally, a thickness of each of the at least one active layer is 20 $\mu$m or less.

Still optionally, the total number of the at least one active layer and the at least one inactive layer is four or more.

It should be noted that, it is preferable that t/T is 0.8 or less, where t represents a thickness of the at least one active layer and T represents the entire thickness of the at least one active layer and the at least one inactive layer. More preferably, t/T is 0.7 or less.

Optionally, conditions below may be satisfied:

$$0.1\ \text{mm} \leqq L \leqq 1\ \text{mm, and}$$

$$0.3 \leqq \delta/L \leqq 1,$$

where,

L represents a width of the at least one active layer in a shorter side, and

δ represents a width of each of the driving electrodes in a direction similar to the width L of the at least one active layer.

In a particular case, all of the at least one active layer and the at least one inactive layer are formed of the same material.

Optionally, all of the at least one active layer and the at least one inactive layer have substantially the same thickness.

In a particular case, the number of the active layers and the number of the inactive layers are two and one, respectively. The number of the active layers and the number of the inactive layers may be two and two, respectively. Alternatively, the total number of the active layers and the inactive layers may be five, and the number of one of the active layers and inactive layers may be three.

In a particular case, the number of the active layers and the number of the inactive layers are the same. Optionally, a difference between the number of the active layers and the number of the inactive layers may be one.

BRIEF DESCRIPTION OF THE ACCOMPANYING DRAWINGS

Figure 9:
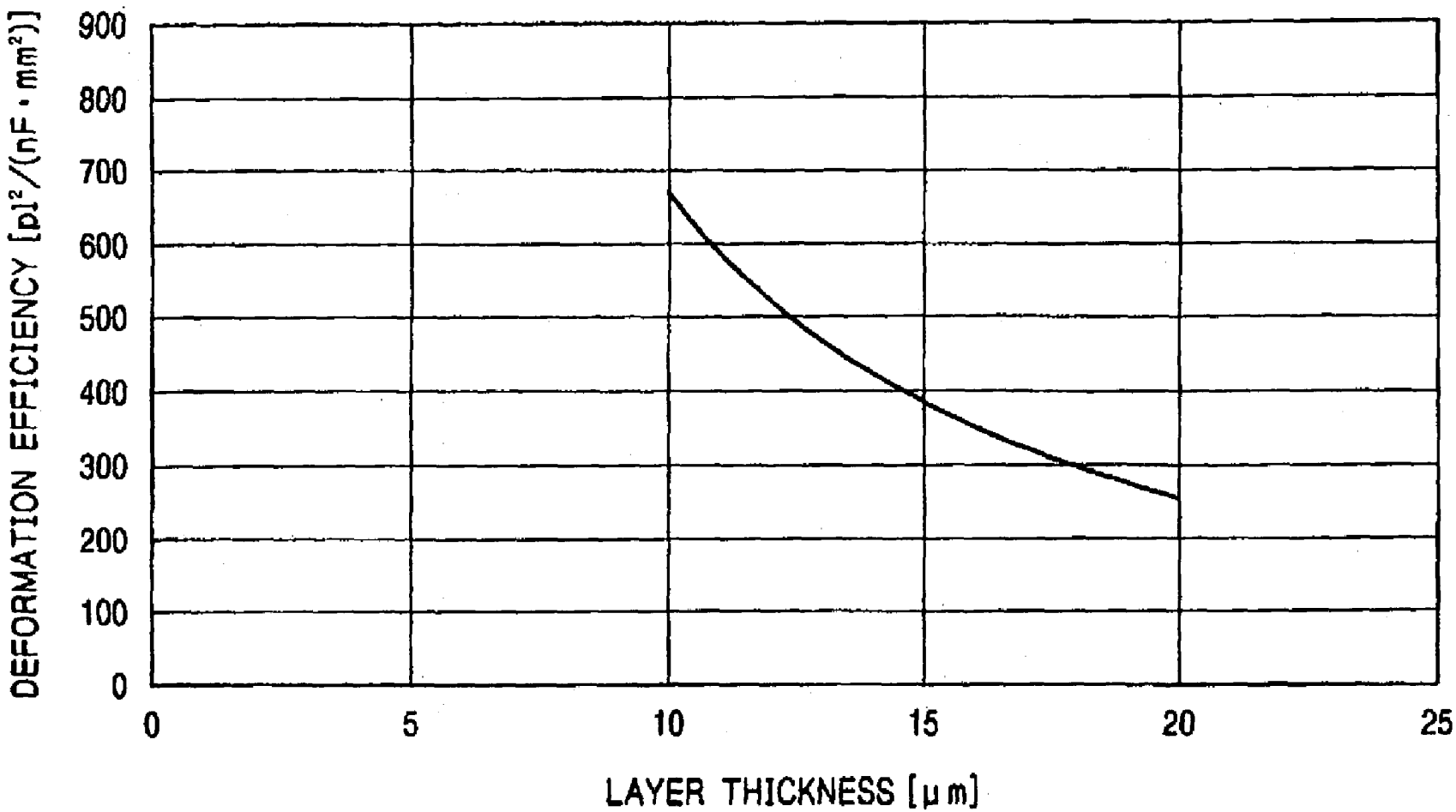
Figure 10:
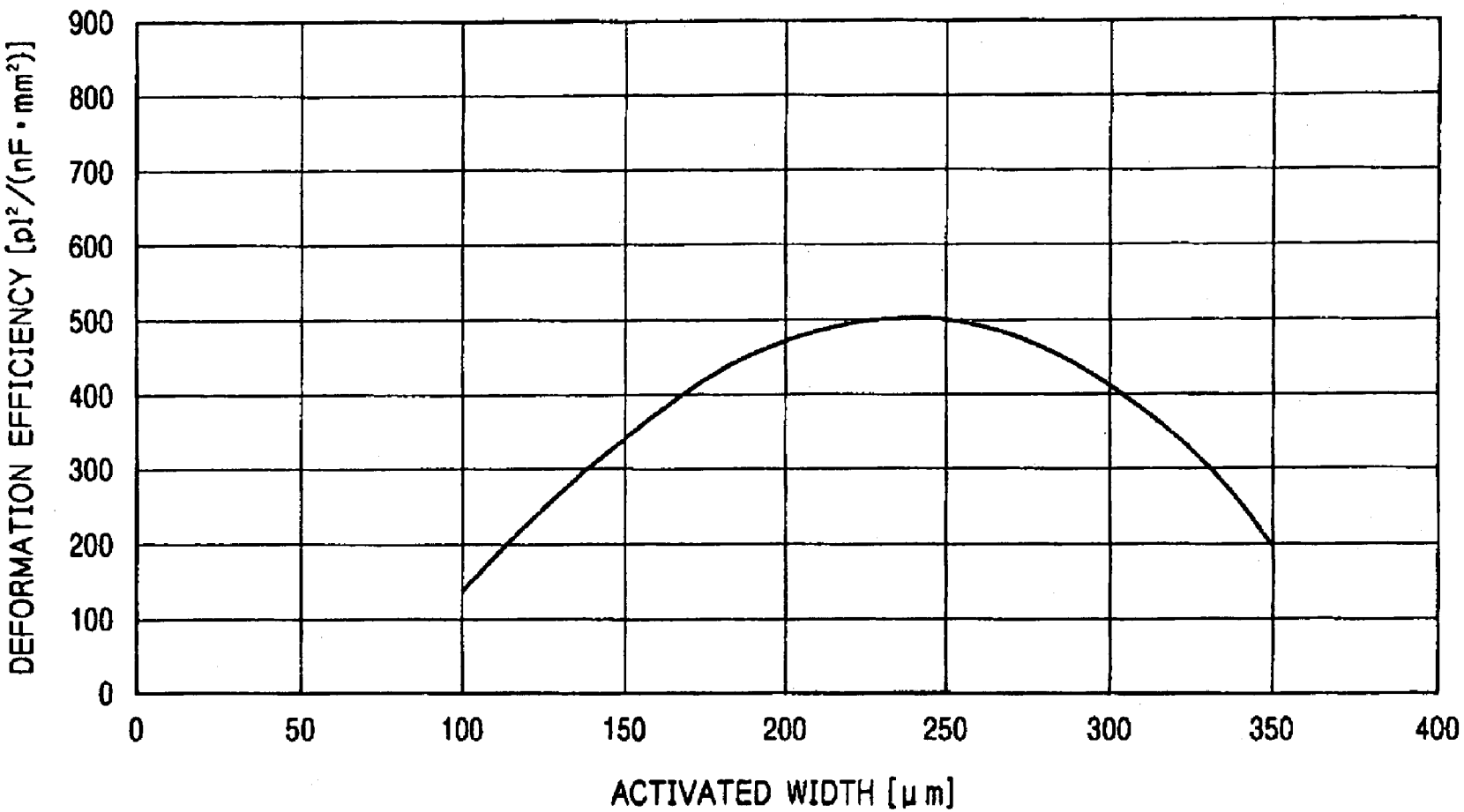

FIG. 9 is a graph showing the deformation efficiencies of the inkjet heads obtained by simulation in which the thickness of active and inactive layers is assumed to be 10 $\mu$m, 15 $\mu$m and 20 $\mu$m; and FIG. 10 is a graph showing the deformation efficiencies of the inkjet heads obtained by simulation in which the activation width is assumed to be 100 $\mu$m, 150 $\mu$m, 200 $\mu$m, 250 $\mu$m, 300 $\mu$m and 350 $\mu$m.

DETAILED DESCRIPTION OF THE EMBODIMENT

Hereinafter, an embodiment according to the invention will be described with reference to the drawings.

Figure 1:
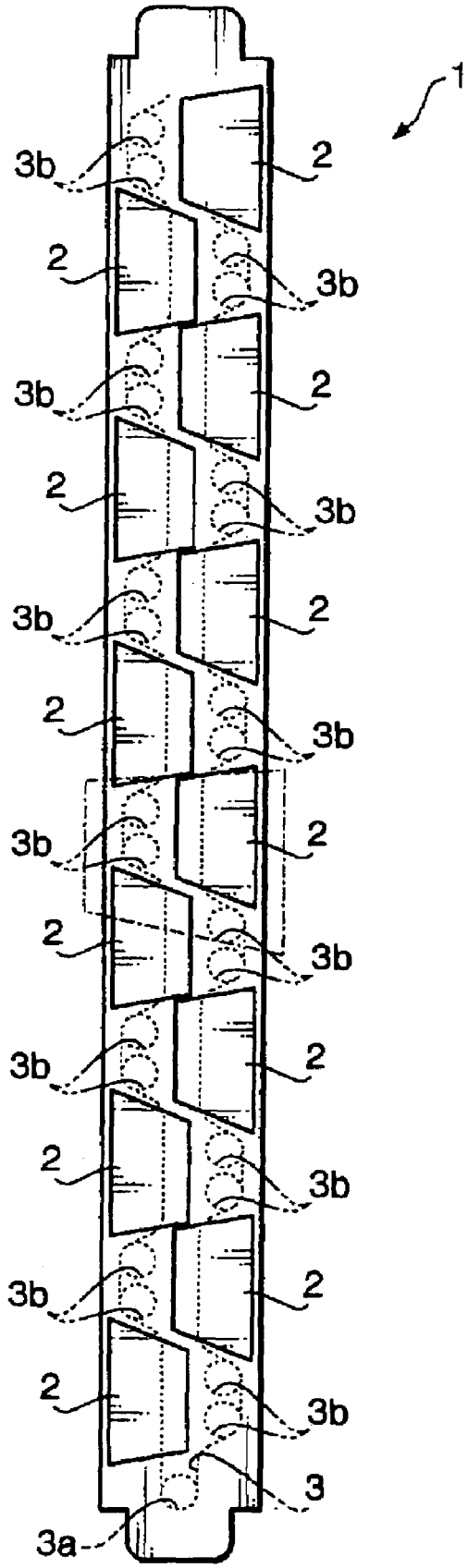
FIG. 1 is a bottom view of an inkjet head according to an embodiment of the invention.
Figure 2:
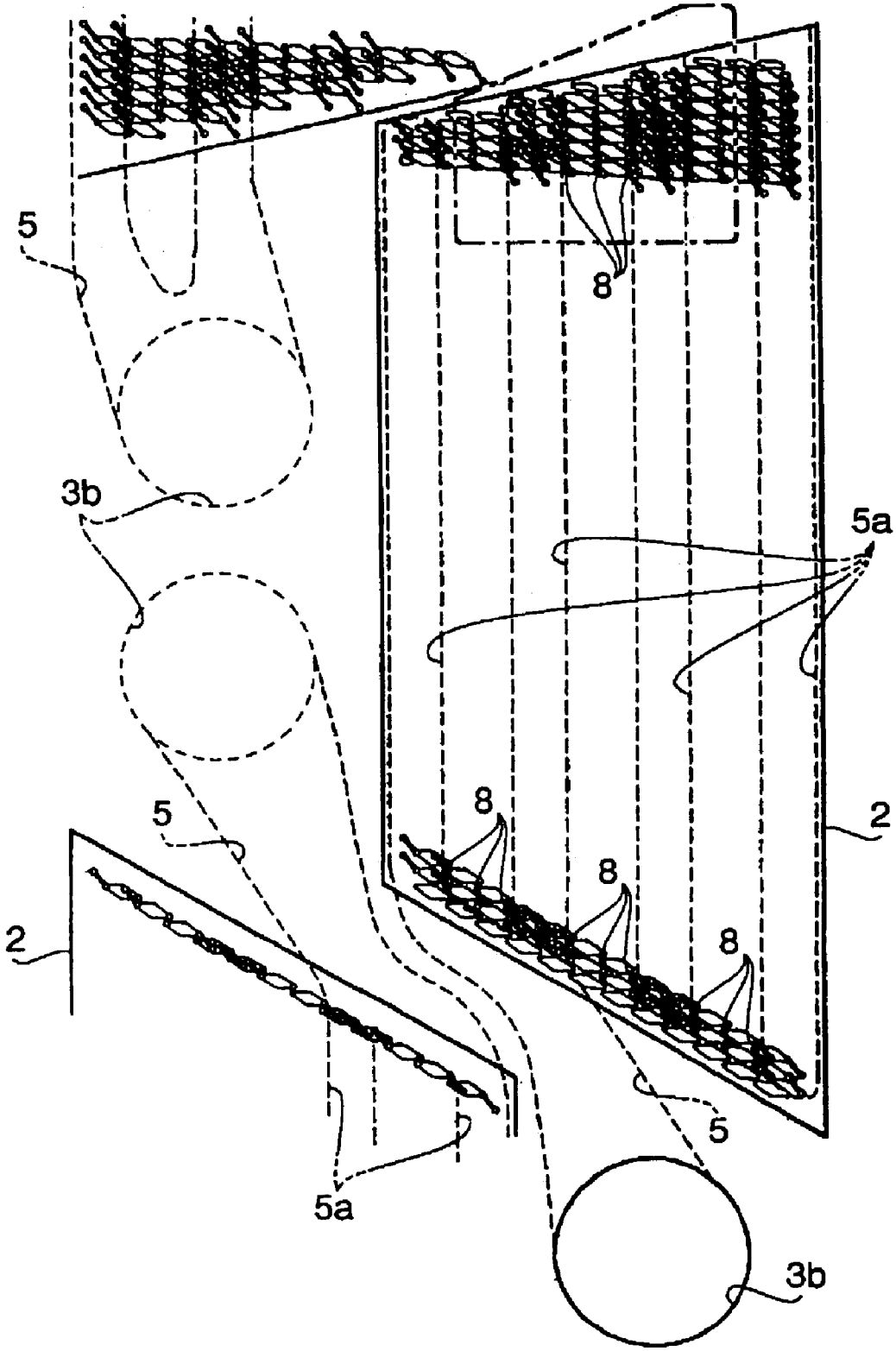
FIG. 2 is an enlarged view of an area surrounded by a dashed line in FIG. 1.
Figure 3:
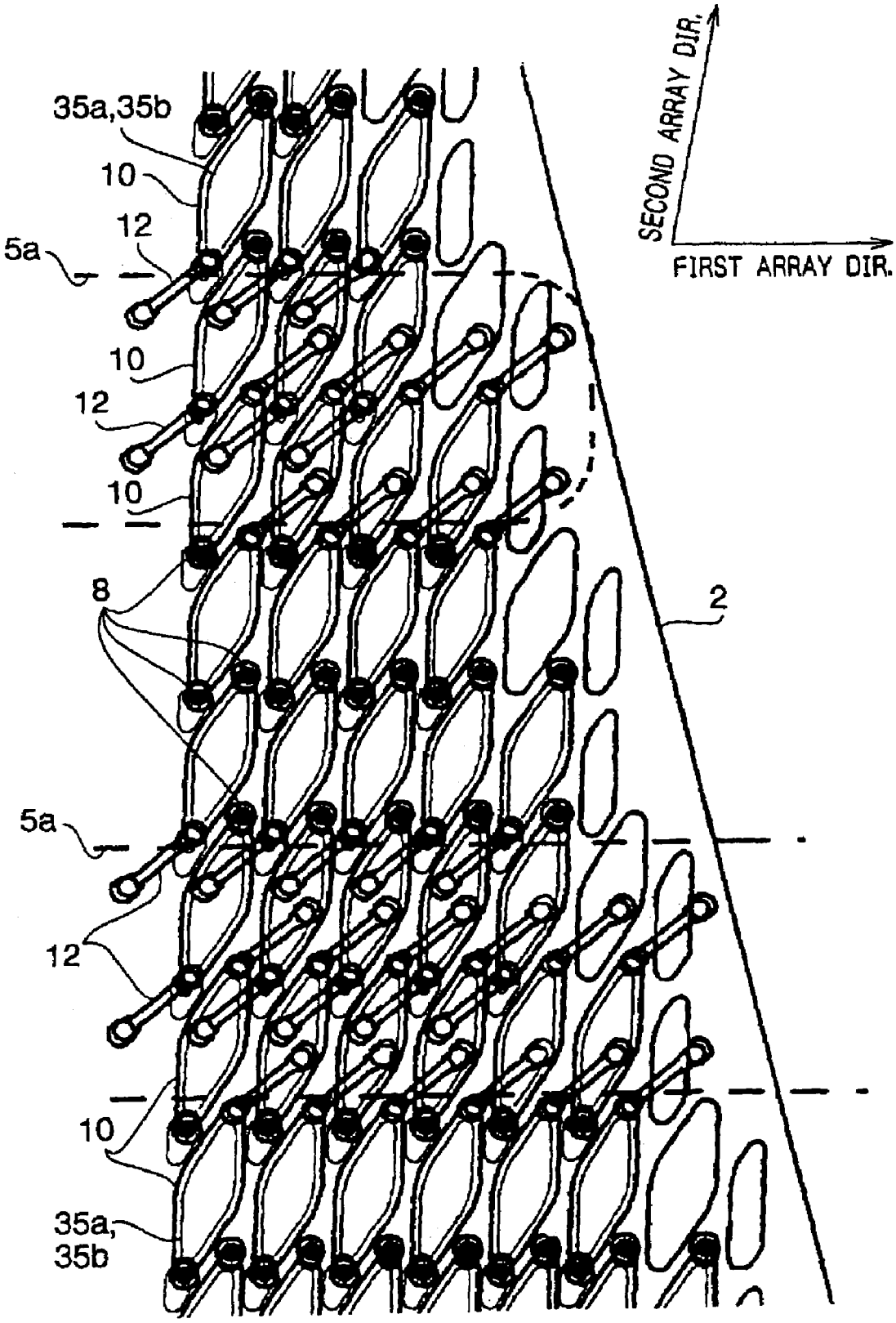
FIG. 3 is an enlarged view of an area surrounded by a dashed line in FIG. 2.
Figure 4:
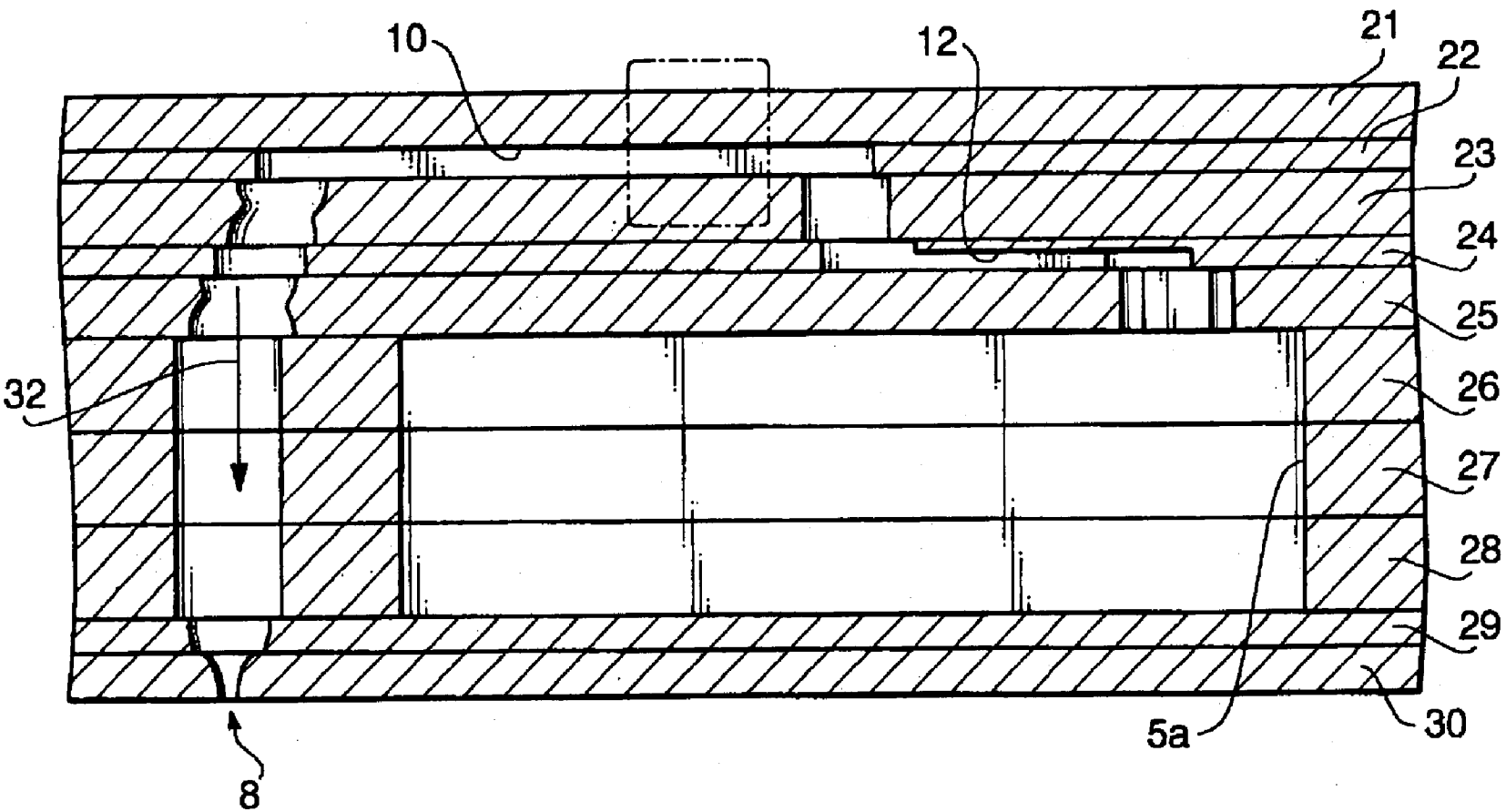
FIG. 4 is a sectional view of a primary part of the inkjet head shown in FIG. 1.
Figure 5:
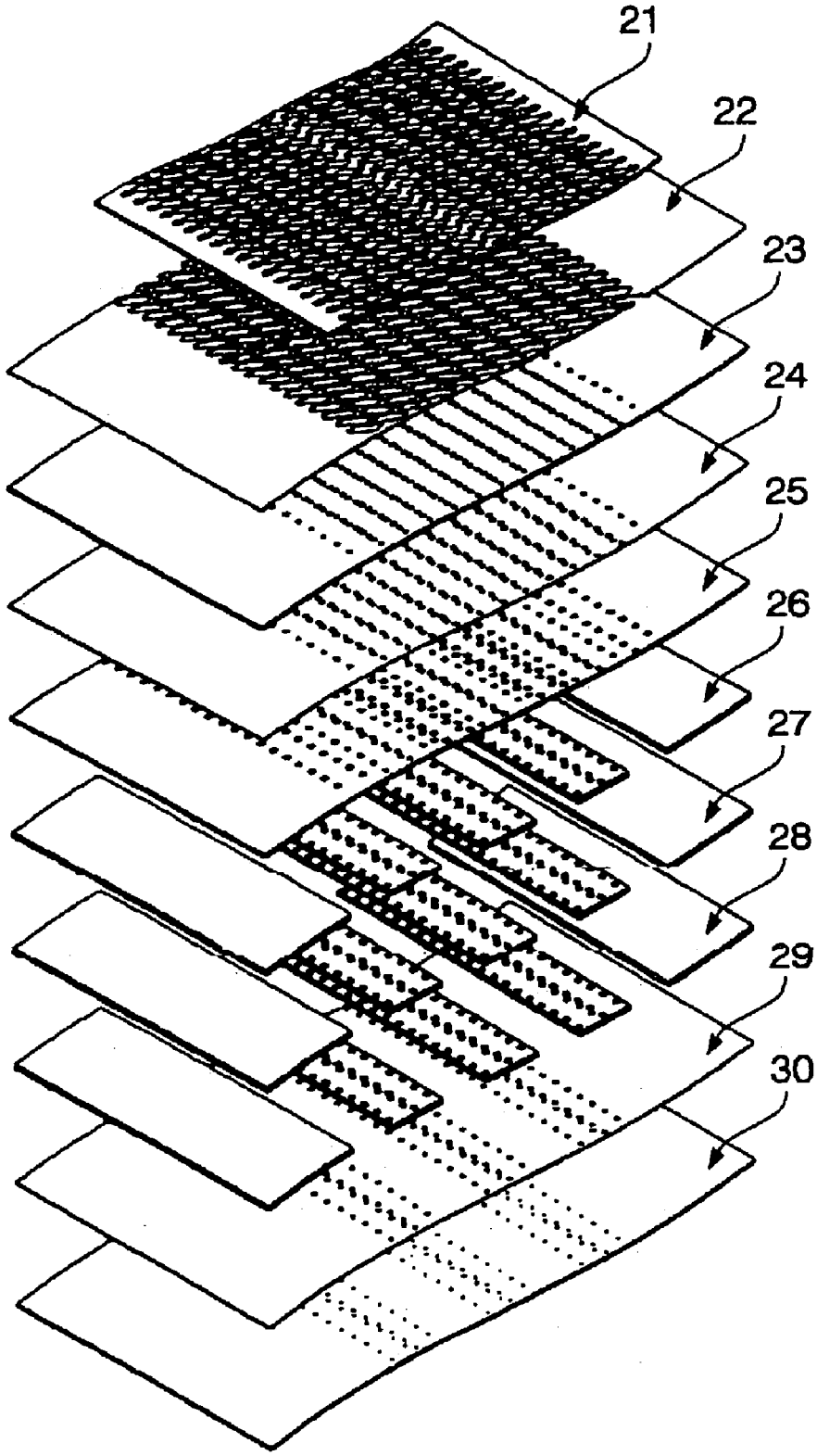
FIG. 5 is an exploded perspective view of the primary part of the inkjet head shown in FIG. 1.
Figure 6:
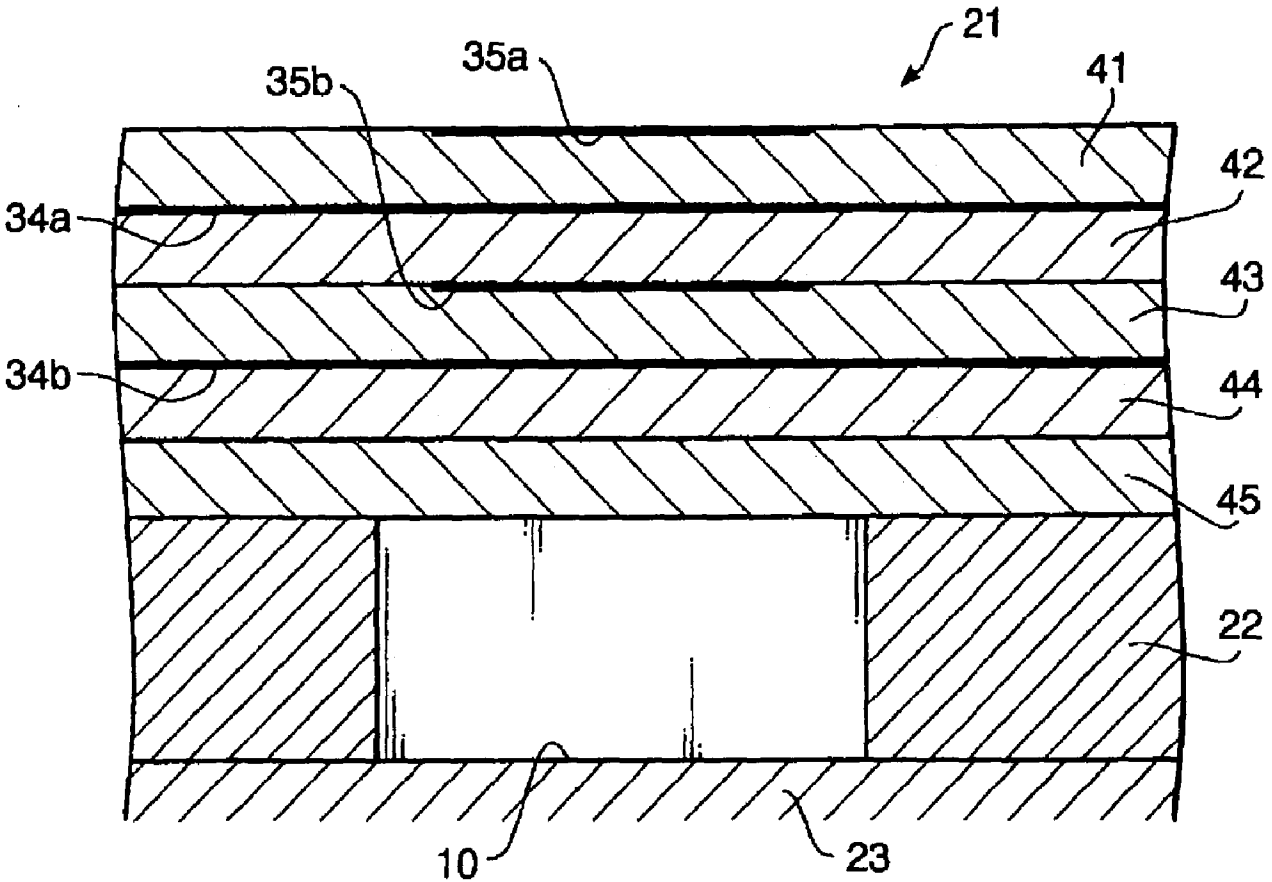
FIG. 6 is an enlarged side view of an area surrounded by a dashed line in FIG. 4.

FIG. 1 is a bottom view of an inkjet head 1 according to an embodiment of the invention. FIG. 2 is an enlarged view of an area surrounded by a dashed line in FIG. 1. FIG. 3 is an enlarged view of an area surrounded by a dashed line in FIG. 2. FIG. 4 is a sectional view of a primary part of the inkjet head 1 shown in FIG. 1. FIG. 5 is an exploded perspective view of the main part of the inkjet head shown in FIG. 1. FIG. 6 is an enlarged side view of an area surrounded by a dashed line in FIG. 4.

The inkjet head 1 is employed in an inkjet printing apparatus, which records an image on a sheet by ejecting inks in accordance with an image data. As shown in FIG. 1, the inkjet head 1 according to the embodiment has, when viewed from the bottom, a substantially rectangular shape elongated in one direction (which is a main scanning direction of the inkjet printing apparatus). The bottom surface of the inkjet head 1 is formed with a plurality of trapezoidal ink ejecting areas 2 which are arranged in two lines which extend in the longitudinal direction (i.e., the main scanning direction) of the inkjet head 1, and are also staggering (i.e., alternately arranged on the two lines).

A plurality of ink ejecting openings 8 (see FIGS. 2 and 3) are arranged on the surface of each ink ejecting area 2 as will be described later. An ink reservoir 3 is defined inside the inkjet head 1 along the longitudinal direction thereof. The ink reservoir 3 is in communication with an ink tank (not shown) through an opening 3*a*, which is provided at one end of the ink reservoir 3, thereby the ink reservoir 3 being filled with ink all the time. A plurality of pairs of openings 3*b* and 3*b* are provided to the ink reservoir 3 along the elongated direction thereof (i.e., the main scanning direction), in a staggered arrangement. Each pair of openings 3*b* and 3*b* are formed in an area where the ink ejecting areas 2 are not formed when viewed from the bottom.

As shown in FIGS. 1 and 2, the ink reservoir 3 is in communication with an underlying manifold 5 through the openings 3*b*. Optionally, the openings 3*b* may be provided with a filter for removing dust in the ink passing therethrough. The end of the manifold 5 branches into two sub-manifolds 5*a* and 5*a* (see FIG. 2). The two sub-manifolds 5*a* and 5*a* extend into the upper part of the ink ejecting area 2 from each of the two openings 3*b* and 3*b* which are located besides respective ends of an ink ejecting area 2 in the longitudinal direction of the inkjet head 1. Thus, in the upper part of one ink ejecting area 2, a total of four sub-manifolds 5*a* extend along the longitudinal direction of the inkjet head 1. Each of the sub-manifolds 5*a* is filled with ink supplied from the ink reservoir 3.

As shown in FIGS. 2 and 3, a plurality of ink ejecting openings 8 are arranged on the surface of each ink ejecting area 2. As shown in FIG. 4, each of the ink ejecting openings 8 is formed as a nozzle having a tapered end, and is in communication with the sub-manifold 5*a* through an aperture 12 and a pressure chamber (cavity) 10. The pressure chamber 10 has a planar shape which is generally a rhombus (900 $\mu$m long and 350 $\mu$m wide). An ink channel 32 is formed to extend, in the inkjet head 1, from the ink tank to the ink ejecting opening 8 through the ink reservoir 3, the manifold 5, the sub-manifold 5*a*, the aperture 12 and the pressure chamber 10. It should be noted that, in FIGS. 2 and 3, the pressure chambers 10 and the apertures 12 are drawn in solid lines for the purpose of clarity although they are formed in the interior of the ink ejecting area 2 and therefore should normally be drawn by broken lines.

Further, as can be seen in FIG. 3, the pressure chambers 10 are arranged close to each other within the ink ejecting area 2 so that an aperture 12, which is in communication with one pressure chamber 10 overlaps the adjacent pressure chamber 10. Such an arrangement can be realized since the pressure chambers 10 and the apertures 12 are formed at different levels (heights), as shown in FIG. 4. The pressure chambers 10 can be arranged densely so that high resolution images can be formed with the inkjet head 1 occupying an relatively small area.

The pressure chambers 10 are arranged within the ink ejecting areas 2, which are within the plane shown in FIG. 2, along two directions, i.e., the longitudinal direction of the inkjet head 1 (first array direction) and a direction slightly inclined with respect to a width direction of the inkjet head 1 (second array direction). The ink ejecting openings 8 are arranged with a density of 50 dpi in the first array direction. There are twelve pressure chambers 10 at the maximum in the second array direction in each of the ink ejecting areas 2. It should be noted that a relative displacement of a pressure chamber 10 located at one end of the array of 12 pressure chambers 10 and another pressure chamber 10 at the other end of the array corresponds to a size of the pressure chamber 10 in the first array direction. Thus, between two ink ejecting openings 8 adjacently arranged in the first array direction, twelve ink ejecting openings 8 exist although they are different in positions in the width direction of the inkjet head 1. It should be noted that, in arrays on the peripheral portion in the first direction, the number of the pressure chambers 10 is less than twelve. However, the peripheral portion of the next ejecting area 2 (the arrays thereof opposing the arrays having less than twelve pressure chambers 10) is configured to compensate for each other, and thus, as the inkjet head 1 as a whole, the above condition is satisfied.

Thus, the inkjet head 1 according to the embodiment is capable of performing printing with a resolution of 600 dpi in the main scanning direction by ejecting ink from the plurality of ink ejecting openings 8 arranged in the first and second array directions in accordance with the movement of the inkjet head 1 in the width direction relative to a sheet.

Next, the sectional configuration of the inkjet head 1 will be described. As shown in FIGS. 4 and 5, the main part at the bottom side of the inkjet head 1 has a laminated structure in which a total of ten sheet members are laminated. The ten sheet members are the actuator unit 21, a cavity plate 22, a base plate 23, an aperture plate 24, a supplier plate 25, manifold plates 26, 27, 28, a cover plate 29, and a nozzle plate 30, in this order from the top.

The actuator unit 21 is configured, as will be described later in more detail, such that five piezoelectric sheets are laminated. Electrodes are provided to the actuator unit 21 so that three of the sheets are active and the other two are inactive. The cavity plate 22 is a metal plate provided with a plurality of openings of generally rhombus shape to form the pressure chamber 10. The base plate 23 is a metal plate including, for each pressure chamber 10 of the cavity plate 22, a communication hole for connecting the pressure chamber 10 and the aperture 12 and a communication hole extending from the pressure chamber 10 toward the ink ejecting opening 8. The aperture plate 24 is a metal plate including, in addition to the apertures 12, a communication hole extending from the pressure chamber 10 to the ink ejecting opening 8 for each pressure chamber 10 of the cavity plate 22. The supplying plate 25 is a metal plate including, for each pressure chamber 10 of the cavity plate 22, a communication hole for connecting the aperture 12 and the sub-manifold 5*a* and a communication hole extending from the pressure chamber 10 toward the ink ejecting opening 8. The manifold plates 24 are metal plates including, in addition to the sub-manifold 5*a*, a communication hole extending from the pressure chamber 10 toward the ink ejecting opening 8 for each pressure chamber 10 of the cavity plate 22. The cover plate 29 is a metal plate including, for each pressure chamber 10 of the cavity plate 22, a communication hole extending from the pressure chamber 10 to the ink ejecting opening 8. The nozzle plate 30 is a metal plate having, for each pressure chamber 10 of the cavity plate, one tapered ink ejecting opening 8 which serves as a nozzle.

The ten sheet members 21 through 30 are laminated after being aligned to form an ink channel 32 as shown in FIG. 4. This ink channel 32 extends upward from the sub-manifold 5*a*, and then horizontally at the aperture 12. The ink channel 32 then extends further upward, then horizontally at the pressure chamber 10, and then obliquely downward for a certain length in a direction away from the aperture 12, and then vertically downward toward the ink ejecting opening 8.

As shown in FIG. 6, the actuator unit 21 includes five piezoelectric sheets 41, 42, 43, 44, 45, having substantially the same thickness of about 15 μm. These piezoelectric sheets 41 through 45 are continuous planar layers. The actuator unit 21 is arranged to extend over a plurality of pressure chambers 10 which are within one of the ink ejecting areas 2 of the inkjet head 1. Since the piezoelectric sheets 41 through 45 extend over a plurality of pressure chambers 10 as the continuous planar layers, the piezoelectric element has high mechanical rigidity and improves the speed of response regarding ink ejection of the inkjet head 1.

A common electrode 34*a*, having a thickness of about 2 μm, is formed over between the uppermost piezoelectric sheet 41 and the piezoelectric sheet 42. Similar to the common electrode 34*a*, another common electrode 34*b*, having a thickness of about 2 μm, is also formed over between the piezoelectric sheet 43, which is immediately below the piezoelectric sheet 42, and the piezoelectric sheet 44 immediately below the sheet 43. Further, driving electrodes (individual electrode) 35*a* are formed for respective pressure chambers 10 on the top of the piezoelectric sheet 41 (see also FIG. 3). Each driving electrode 35*a* is 1 μm thick and the top view thereof has a shape substantially similar to that of the pressure chamber 10 (e.g., 850 μm long, 250 μm wide). Each driving electrode 35*a* is arranged such that its projection in the layer stacking direction is within the pressure chamber 10. Further, driving electrodes 35*b*, each having a thickness of about 2 μm, are formed between the piezoelectric sheet 42 and the piezoelectric sheet 43 in a similar manner to that of the driving electrodes 35*a*. However, no electrodes are provided between the piezoelectric sheet 44, which is immediately below the piezoelectric sheet 43, and the piezoelectric sheet 45 immediately below the sheet 44, and below the piezoelectric sheet 45.

The common electrodes 34*a*, 34*b* are grounded. Thus, each area of the common electrodes 34*a*, 34*b* corresponding to the pressure chambers 10 is equally kept at ground potential. The driving electrodes 35*a* and 35*b* are connected to drivers (not shown) by separate lead wires (not shown), respectively, so that the potential of the driving electrodes can be controlled for each pressure chamber 10. Note that the corresponding driving electrodes 35*a*, 35*b* forming a pair (i.e., arranged in up and down direction) may be connected to the driver by the same lead wire.

It should be also noted that the common electrodes 34*a*, 34*b* are not necessarily formed as one sheet extending over the whole area of the piezoelectric sheet, however, a plurality of common electrodes 34*a*, 34*b* may be formed in association with the pressure chambers 10 such that the projection thereof in the layer stacked direction covers the whole area of the corresponding pressure chamber 10, or such that the projection thereof is included within the area of the corresponding pressure chamber 10. In such cases, however, it is required that the common electrodes are electrically connected so that the areas thereof corresponding to the pressure chambers 10 are at the same potential.

In the inkjet head 1 according to the embodiment, the direction of polarization of the piezoelectric sheets 41 through 45 coincides with the thickness direction thereof. The actuator unit 21 is configured to form a so-called unimorph type actuator, in which three piezoelectric sheets 41 through 43 on the upper part (the sheets distant from the pressure chamber 10) are active layers and the other two piezoelectric sheets 44, 45 at the lower part (the part closer to the pressure chamber 10) are inactive layers. When the driving electrodes 35*a*, 35*b* are set to a predetermined positive/negative potential, if the direction of electrical field coincides with the direction of polarization, the portions in the piezoelectric sheets 41 through 43 (i.e., the active layers) sandwiched between the electrodes contract in a direction perpendicular to the polarization direction. In the meantime, the piezoelectric sheets 44, 45, which are not affected by the electric field, do not voluntarily contract. Thus, the upper layer piezoelectric sheets 41 through 43 and the lower layer piezoelectric sheets 44, 45 deform differently in the polarization direction, and the piezoelectric sheets 41 through 45 as a whole deform such that the inactive layer side becomes convex (unimorph deformation). Since, as shown in FIG. 6, the bottom surface of the piezoelectric sheets 41 through 45 is fixed on the top surface of the cavity plate 22 providing partitions, which define the pressure chambers 10, the piezoelectric sheets 41 through 45 become convex toward the pressure chamber side. Accordingly, the volume of the pressure chamber 10 decreases, which increases the pressure of the ink and causes the ink to be ejected from the ink ejecting opening 8.

If, thereafter, the application of the driving voltage to the driving electrodes 35*a*, 35*b* is cut, the piezoelectric sheets 41 through 45 recover to the neutral shapes (i.e., a planar shape as shown in FIG. 6) and hence the volume of the pressure chamber 10 recovers (i.e., increases) to the normal volume, which results in suction of ink from the manifold 5.

Note that in an alternative driving method, the voltage is initially applied to the driving electrodes 35*a*, 35*b*, cut on each ejection requirement and re-applied at a predetermined timing after certain duration. In this case, the piezoelectric sheets 41 through 45 recover their normal shapes when the application of voltage is cut, and the volume of the pressure chamber 10 increases compared to the initial volume (i.e., in the condition where the voltage is applied) and hence ink is drawn from the manifold 5. Then, when the voltage is applied again, the piezoelectric sheets 41 through 45 deform such that the pressure chamber side thereof become convex to increase the ink pressure by reducing the volume of pressure chamber, and thus the ink is ejected.

If the direction of the electric field is opposite to the direction of polarization, the portions of the piezoelectric sheets 41 through 43, or active layers, that are sandwiched by the electrodes expand in a direction perpendicular to the polarization direction. Accordingly, in this case, the portions of the piezoelectric sheets 41 through 45 that are sandwiched by electrodes 34*a*, 34*b*, 35*a*, 35*b* bend by piezoelectric transversal effect so that the pressure chamber side surfaces become concave. Thus, when the voltage is applied to the electrodes 34*a*, 34*b*, 35*a* and 35*b*, the volume of the pressure chamber 10 increases and ink is drawn from the manifold 5. Then, if the application of the voltage to the driving electrodes 35*a*, 35*b* is stopped, the piezoelectric sheets 41 through 45 recover to their normal form, and hence the volume of the pressure chamber 10 recovers to its normal volume, thereby the ink being ejected from the nozzle.

The inkjet head 1 can improve the electrical efficiency (i.e., change of the volume of the pressure chamber 10 per unit electrostatic capacity) or the area efficiency (i.e., change of the volume of the pressure chamber 10 per unit projected area) compared to those of the inkjet head having the active layers at the pressure chamber side and the inactive layers at the opposite side as described in the previously mentioned publication (see FIG. 7), since it has a plurality of piezoelectric sheets 41 through 43 as active layers and a plurality of piezoelectric sheets 44, 45 as inactive layers. The improvements in electrical efficiency and area efficiency allow downsizing of the drivers for the electrodes 34*a*, 34*b*, 35*a* and 35*b*, which contributes to decrease the manufacturing cost thereof. Further, as the drivers for the electrodes 34*a*, 34*b*, 35*a*, 35*b* are downsized, the pressure chambers 10 can be made compact. Accordingly, even if the pressure chambers 10 are highly integrated, sufficient amount of ink can be ejected. Therefore, downsizing of the inkjet head 1 and high density of the printed dots can be achieved. This effect is particularly significant when the sum of the numbers of the active and inactive layers is four or more. It should be noted that even in a combination of one active layer and a plurality of inactive layers, or a plurality of active layers and one inactive layer (e.g., one active layer and two inactive layers, or, two active layers and one inactive layer), it is expected that the electrical efficiency or the area efficiency is improved compared to those of the conventional inkjet head.

The above-mentioned effect is remarkable since, in the inkjet head 1, the thickness of each active layer, i.e., each of the piezoelectric sheets 41 through 43, is relatively thin, i.e., 15 $\mu$m. As will be described later, it is desirable to keep the thickness of each of the piezoelectric sheets 41 through 43 at 20 $\mu$m or lower in order to improve the electrical efficiency or area efficiency (see FIG. 9).

Further, in the inkjet head 1, the total thickness of the active layers and the inactive layers (the total thickness of the piezoelectric sheets 41 through 45) is 75 $\mu$m, and the thickness of the active layers (the total thickness of the piezoelectric sheets 41 through 43) is 45 $\mu$m, and hence the ratio of the two is 45/75=0.6. Because of this configuration, the above-mentioned effect is further remarkable in the inkjet head 1.

As will be describe later in more detail, from the viewpoint of improving electrical efficiency or area efficiency, it is preferably that t/T is 0.8 or lower, and more preferably 0.7 or lower, where T represents the total thickness of the active and the inactive layers (the total thickness of the piezoelectric sheets 41 through 45), and t represents the thickness of the active layers (the total thickness of the piezoelectric sheets 41 through 43).

The above-mentioned effect is remarkable in the inkjet head 1 according to the embodiment, since the length of the pressure chamber 10 in the transverse direction is 350 $\mu$m, and the length (activation width) of the driving electrodes 35*a*, 35*b* in the same direction is 250 $\mu$m, and hence the ratio of the two is 250/350=0.714 . . . . As will be described later in more detail, from viewpoint of improving electrical efficiency and area efficiency, it is preferable that conditions $0.1\ \text{mm} \leqq L \leqq 1\ \text{mm}$ and $0.3 \leqq \delta/L \leqq 1$ are satisfied, where L represents the length of the pressure chamber 10 in the transverse direction and $\delta$ represents the length of the driving electrodes 35*a*, 35*b* in the direction the same as that of length L (see FIG. 10).

Further, the electrode located at the most pressure chamber side among the four electrodes 34*a*, 34*b*, 35*a* and 35*b* in the inkjet head 1 is utilized as the common electrode (34*b*). This configuration prevents unstable printing due to the effect of potential variation of the driving electrodes 35*a*, 35*b* on the ink, which has conductivity.

In the embodiment, the piezoelectric sheets 41 through 45 are made of Lead Zirconate Titanate (PZT) material which shows ferroelectricity. The electrodes 34*a*, 34*b*, 35*a* and 35*b* are made of metal of, for example, Ag—Pd family.

The actuator unit 21 is made by stacking the ceramic material for the piezoelectric sheet 45, the ceramic material for piezoelectric sheet 44, the metal material for the common electrode 34*b*, the ceramic material for the piezoelectric sheet 43, the metal material for the driving electrode 35*b*, the ceramic material for the piezoelectric sheet 42, the metal material for the common electrode 34*a*, and the ceramic material for piezoelectric sheet 41, and then baking the stack. Then, the metal material for the driving electrode 35*a* is plated on the whole surface of the piezoelectric sheet 41, and unnecessary portions thereof are removed by means of laser patterning.

Alternatively, the driving electrodes 35*a* are coated on the piezoelectric sheet 41 by means of vapor deposition using a mask having openings at locations where to the driving electrodes 35*a* are to be formed.

In contrast to other electrodes, the driving electrodes 35*a* are not baked together with the ceramic materials of the piezoelectric sheets 41 through 45. This is because the driving electrodes 35*a* are exposed to outside and therefore are easy to vaporize when they are baked at high temperature which makes the control of the thickness of the driving electrodes 35*a* relatively difficult compared to other electrodes 34*a*, 34*b*, 35*b* which are covered with the ceramic materials. The thickness of the other electrodes 34*a*, 34*b*, 35*b*, however, also decreases more or less when baked. Therefore, it is difficult to make these electrodes thin with keeping them continuous even after the baking. On the contrary, the driving electrodes 35*a* can be made as thin as possible in contrast with the other electrodes 34*a*, 34*b* and 35*b* since the driving electrodes 35*a* are formed by the above-mentioned method after the baking. As above, in the inkjet head 1 according to the embodiment, the driving electrodes 35*a* on the most upper layer, are made thinner than the other electrodes 34*a*, 34*b*, 35*b* and therefore do not obstruct the displacement of the piezoelectric sheets 41 through 43 (i.e., the active layers) so much, which in turn improves the efficiency (electrical efficiency and area efficiency) of the actuator unit 21.

In the inkjet head 1, the piezoelectric sheets 41 through 43, or the active layers, and the piezoelectric sheets 44, 45, or the inactive layers, are made of the same material. Accordingly, the inkjet head 1 can be produced by a relatively simple manufacturing process, which does not require exchange of materials. Therefore, reduction of manufacturing cost is expected. Further, since all of the piezoelectric sheets 41 through 43, or the active layers, and the piezoelectric sheets 44, 45, or the inactive layers, have substantially the same thickness, the manufacturing process can be simplified, which further reduces the manufacturing cost. This is because, it is possible to simplify the process for adjusting the thickness of the ceramic materials applied and stacked for forming the piezoelectric sheets.

In addition, in the inkjet head 1 according to the embodiment, the actuator units 21 are sectionalized for every ink ejecting area 2. This is because, if the actuator units 21 are formed uniformly, the small displacement between the cavity plate 22 and the actuator unit 21 overlaid thereon increases at the distance farther from the alignment point and results in large displacements of the driving electrodes 35*a*, 35*b* of the actuator unit 21 from the corresponding pressure chambers 10. According to the embodiment, such displacement hardly occurs and a good accuracy of alignment is achieved.

The preferred embodiment of the invention has been described in detail. It should be noted that the invention is not limited to the configuration of the above described exemplary embodiment, and various modifications are possible without departing from the gist of the invention.

For example, the materials of the piezoelectric sheets and the electrodes are not limited to those mentioned above, and can be replaced with other appropriate materials. Further, the planar shape, the sectional shape, and the arrangement of the pressure chambers may be modified appropriately. The number of the active and inactive layers may be changed under the condition that the numbers of the active layers or the inactive layers is two or more. Further, the active and the inactive layer may have different thickness.

CONCRETE EXAMPLES

Hereinafter, concrete examples of the inkjet heads according to the embodiment, and comparative examples will be described.

First Concrete Example

In the first concrete example, the active layers, the inactive layers and the pressure chambers are located in this order from the top to the bottom.

The electrical efficiency and area efficiency are obtained by simulation for an inkjet head which has a structure similar to the above-described structure except that there are two active layers (width of the driving electrodes are 200 $\mu$m), and two inactive layers. The thickness of each of the active and inactive layers is 15 $\mu$m. The result is shown in TABLE 1. The simulation is performed such that a pressure corresponding to the maximum pressure in the pressure chamber is applied to the entire bottom surface of the piezoelectric element (the following simulations are performed similarly).

Second and Third Concrete Examples

The electric efficiency and area efficiency are obtained by simulation for an inkjet head which is manufactured in the same manner as that of the inkjet head 1 of the concrete first example except that the width of the driving electrode is 250 $\mu$m in the second concrete example and 300 $\mu$m in the third concrete example. The results are shown in TABLE 1.

Fourth Through Seventh Concrete Examples

The electric efficiency and area efficiency are obtained by simulation for an inkjet head which has an arrangement similar to that of the above-described embodiment except that there are three active layers (Example 4: the width of the driving electrode on the top layer is 250 $\mu$m and those of the other two driving electrodes are 300 $\mu$m, Example 5: the width of the driving electrode on the top layer is 200 $\mu$m and those of the other two driving electrodes are 300 $\mu$m, Example 6: the width of each driving electrode is 300 $\mu$m, Example 7: the width of the driving electrode on the top layer is 150 $\mu$m and those of the other two are 300 $\mu$m), and two inactive layers. The thickness of each active and inactive layers is 15 $\mu$m. The result is shown in table 1.

Comparative Example

The electric efficiency and area efficiency are obtained by simulation for an inkjet head having an arrangement similar to that disclosed in Japanese Patent provisional publication No. HEI 4-341852 (number of layers: 10, thickness of layer: 30 $\mu$m). The result is shown in table 1.

TABLE 1

| | Number of Layers | Thickness of Layer [$\mu$m] | Total Thickness [$\mu$m] | Width of Driving Electrode: First Layer | Second Layer | Third Layer | Electric Efficiency [pl/nF] | Area Efficiency [pl/mm$^2$] | D.F. [pl$^2$/nF × mm$^2$] |
|---|---|---|---|---|---|---|---|---|---|
| Comparative Example | 10 | 30 | | | | | 7.143 | 10.204 | 72.886 |
| Example 1 | 4 | 15 | 60 | 200 | 200 | | 13.000 | 33.311 | 433.051 |

TABLE 1-continued

| | Number of Layers | Thickness of Layer [μm] | Total Thickness [μm] | Width of Driving Electrode First Layer | Second Layer | Third Layer | Electric Efficiency [pl/nF] | Area Efficiency [pl/mm²] | D.F. [pl²/nF × mm²] |
|---|---|---|---|---|---|---|---|---|---|
| Example 2 | 4 | 15 | 60 | 250 | 250 | | 11.260 | 36.064 | 406.085 |
| Example 3 | 4 | 15 | 60 | 300 | 300 | | 9.971 | 38.324 | 382.149 |
| Example 4 | 5 | 15 | 75 | 250 | 300 | 300 | 8.209 | 44.698 | 366.943 |
| Example 5 | 5 | 15 | 75 | 200 | 300 | 300 | 8.370 | 42.890 | 358.974 |
| Example 6 | 5 | 15 | 75 | 300 | 300 | 300 | 7.782 | 44.864 | 349.132 |
| Example 7 | 5 | 15 | 75 | 150 | 300 | 300 | 8.467 | 40.676 | 344.396 |

D.F.: Deformation Efficiency = Electrical Efficiency × Area Efficiency

Figure 7:
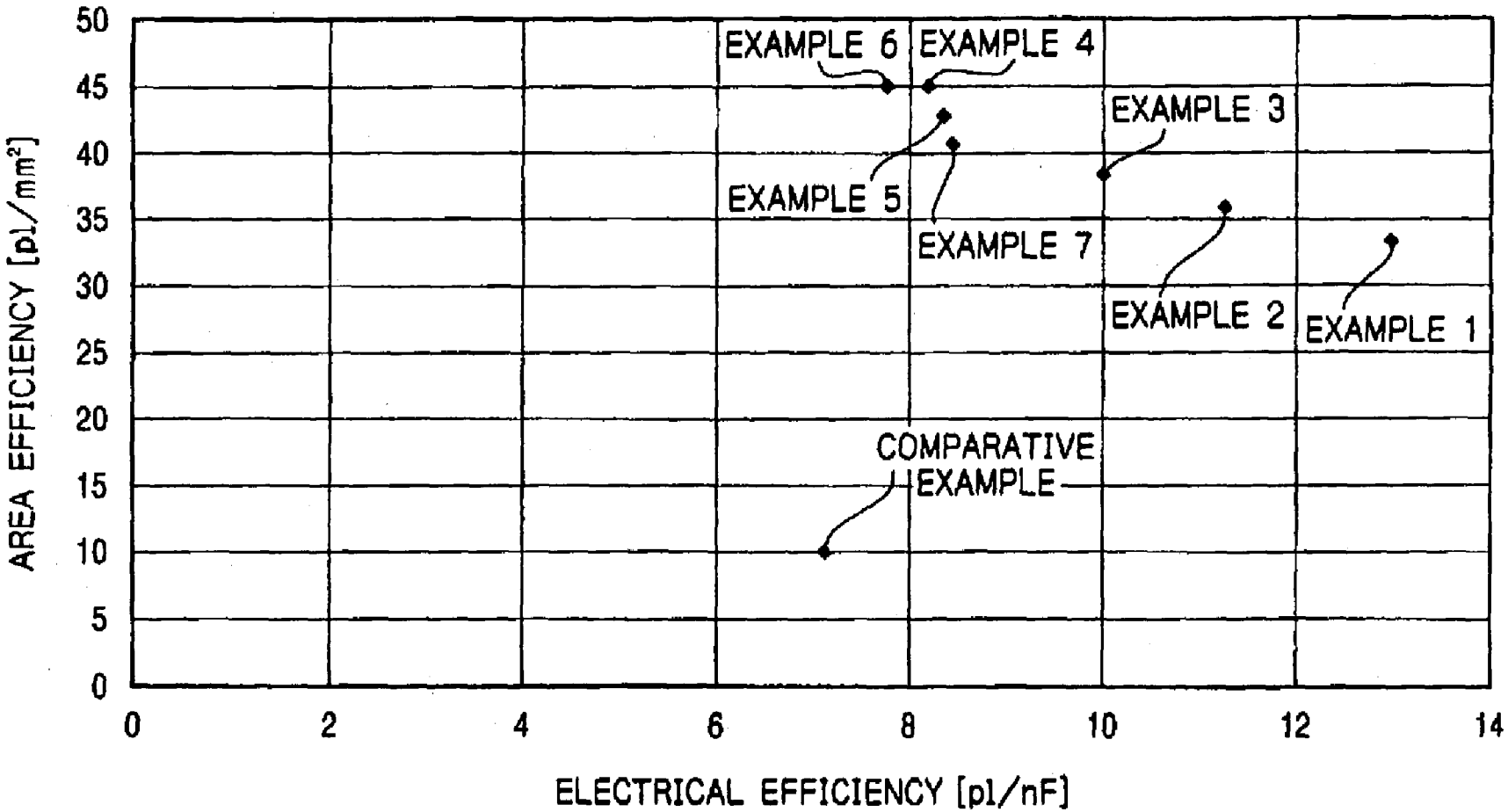
FIG. 7 is graph showing electrical efficiencies and the area efficiencies of the inkjet heads of the examples obtained by simulation.

FIG. 7 is a graph indicating the results shown in TABLE 1. As is clearly shown in FIG. 7, the inkjet heads of first through seventh examples, which include a plurality of active layers or a plurality of inactive layers, exhibit excellent electrical efficiency and area efficiency compared to that of the comparative example 1 according to the prior art. Specifically, in comparison to the comparative example 1, the electrical efficiency is one to two times larger and the area efficiency is three to four times larger. Thus, the inkjet heads of the first through seven examples can realize higher integrating density of the pressure chambers and further downsizing of the drivers.

The Number of Layers

Hereinafter, the total number of the active and inactive layers and a relationship therebetween will be described.

Figure 8:
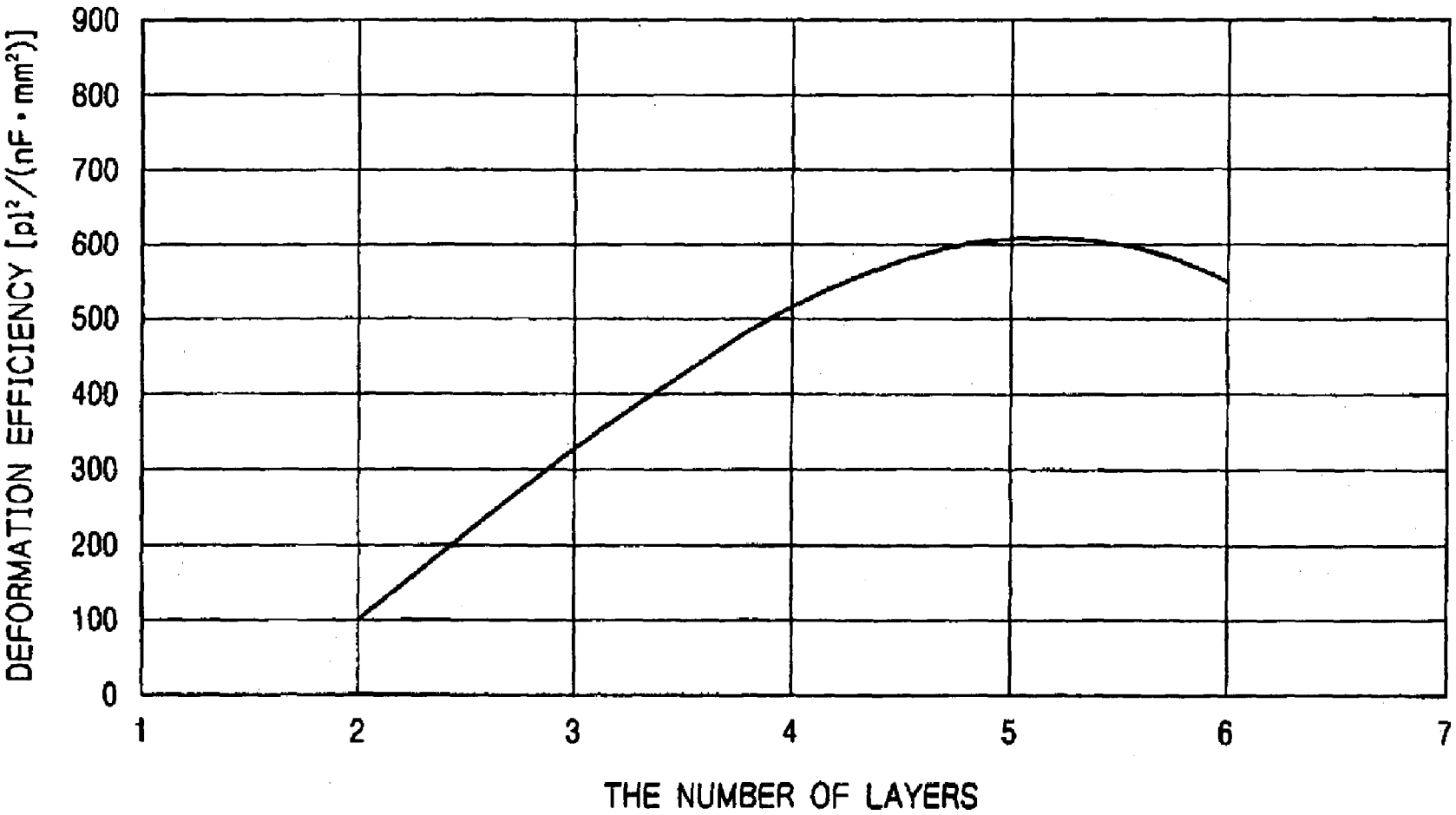
FIG. 8 is a graph showing deformation efficiencies of the inkjet heads of the examples obtained by simulation in which the number of active and inactive layers is varied from two to six.

Deformation efficiency, which is the production of the electrical efficiency and the area efficiency, of a plurality of inkjet heads, each having similar arrangement to that of the inkjet head 1, are obtained by simulation by changing the number of the sum of the active and inactive layers within the range of two to six. Large deformation efficiency is preferable for realizing both high integration density of the pressure chambers and downsizing of the drivers. The result of the simulation is shown in FIG. 8. The thickness of the active and inactive layers are the same, and three kinds of thickness, i.e., 10 μm, 15 μm and 20 μm are used. As the width of the driving electrodes, four kinds of widths are used, which ranges from 50 μm to 150 μm at 50 μm steps. The number of the driving electrodes are determined to be one through three, under a condition where at least a plurality of active layers or a plurality of inactive layers are included, except for a case where the number of the layers is two.

As can be seen from FIG. 8, the deformation efficiency is about 100 $pl^2/(nF \cdot mm^2)$ when the number of the layers is two, and increases as the number of layers increases. The deformation efficiency is the maximum value (about 600 $pl^2/(nF \cdot mm^2)$) when the number of the layers is five, and slightly decreases when there are six layers.

Generally, it is considered that the deformation efficiency is larger when the number of the layers is smaller, which differs from the simulation results. This will be explained as follows. Since the inner pressure of the pressure chamber rises up to several atmospheres, the piezoelectric element is required to have mechanical strength sufficient for withstanding that pressure. It is considered that the piezoelectric elements configured by laminated sheets each having a thickness of 20 μm or lower, as in the embodiment, provides the best balance between the deformation of the piezoelectric element due to voltage application and the strength withstanding the inner pressure that acts to deform the piezoelectric element to the opposite direction at about five layers.

The deformation efficiency is higher than that of the comparative example 1 when the number of the layers is two. Further excellent result is obtained when the number of the layers is 3, i.e., when at least a plurality of active layers or a plurality of inactive layers are included. Especially, when the number of the layers is four or more (i.e., four layers, five layers or six layers), extremely excellent results are obtained, and the best result is obtained at five layers. As a matter of course, the total number of the active and inactive layers may be seven or more.

Optimal number of the active layers in a piezoelectric element having a predetermined number of layers (i.e., the sum of the numbers of the active and inactive layers) is examined by simulation (in this case, it is assumed that each layer has the same thickness).

If the number of the layers is three, the number of the active layer is required to be one (thickness of the active layers/total thickness=0.33) or two (thickness of the active layers/total thickness=0.67) to satisfy the condition where at least a plurality of active layers or a plurality of inactive layers are included in the piezoelectric element, and it is found that the number of the active layers is preferably two.

If the number of the layers is four, the number of the active layers is required to be one (active layer thickness/total thickness=0.25), two (thickness of active layers/total thickness=0.5) or three (thickness of active layers/total thickness=0.75) to satisfy the condition where at least a plurality of active layers or a plurality of inactive layers are included in the piezoelectric element, and it is found that the number of the active layers is preferably one or two among the above configurations, and two-layer configuration is more preferable than a one-layer configuration. The deformation efficiency slightly decreases when there are three layers.

If the total layer number is five, the number of the active layers is required to be one (thickness of active layer/total thickness=0.2), two (thickness of active layers/total thickness=0.4), three (thickness of active layers/total thickness=0.6), or four (thickness of active layer/total thickness=0.8) to satisfy the condition where at least a plurality of active layers or a plurality of inactive layers are included in the piezoelectric element, and it is found that the number of the active layers is preferably two or three. The deformation efficiency slightly decreases when there are four active layers.

If the total layer number is six, the number of the active layers is required to be one (thickness of active layer/total thickness=0.17), two (thickness of active layer/total thickness=0.33), three (thickness of active layer/total thickness=0.5), four (thickness of active layer/total thickness=0.67), or five (thickness of active layer/total thickness=0.83) to satisfy the condition where at least a plurality of active layers or a plurality of inactive layers in the piezoelectric element, and it is found that the number of the active layers should be two or three, and between them, three layers is more preferable than two layers. The deformation efficiency slightly decreases when there are five active layers.

If the total layer number is seven, the number of the active layers is required to be one (thickness of active layer/total thickness=0.14), two (thickness of active layer/total thickness=0.29), three (thickness of active layer/total thickness=0.43), four (thickness of active layer/total thickness=0.57), five (thickness of active layer/total thickness=0.71), or six (active layer thickness/total thickness=0.86) to satisfy the condition that at least one of the active and inactive layers is included more than one in the piezoelectric element, and that three or four layers are preferable. The deformation efficiency slightly decreases when there are six layers.

From the result above, it is concluded that t/T is preferably 0.8 or lower, and more preferably t/T is 0.7 or lower, where T represents the total thickness of the active and inactive layers and t represents the thickness of the active layers. Note that it is supposed that the similar result may be obtained even if the thickness of the active layers differs from that of the inactive layers.

Thickness of the Active and Inactive Layers

Deformation efficiency, which is the production of the electrical efficiency and the area efficiency, of a plurality of inkjet heads, each having similar arrangement to that of the inkjet head 1, is obtained by simulation for three different thickness of the active and inactive layers, i.e. 10 μm, 15 μm, and 20 μm. Table 9 shows the result. The total number of the active layers and inactive layers is in a range of three to six (four kinds), the width of the electrodes is within a range of 150 μm to 300 μm at 50 μm step (four kinds), and the number of the driving electrodes one layer to three layers (at least a plurality of active layers or a plurality of inactive layers are included).

As can be seen from FIG. 9, the deformation efficiency exhibits the maximum value of about 660 $pl^2/(nF \cdot mm^2)$ when the layer thickness is 10 μm, and decreases as the thickness of the layer decreases, and is the minimum value (about 250 $pl^2/(nF \cdot mm^2)$) when the thickness is 20 μm. Thus, the thinner the layer is, the better the efficiency is. From the viewpoint of practical use, it is preferable that the thickness is 20 μm or lower.

Width of the Active Layer

Deformation efficiency, which is the production of the electrical efficiency and the area efficiency, of a plurality of inkjet heads, each having similar arrangement to that of the inkjet head 1, is obtained by simulation for six different activation widths, or the lengths of the driving electrodes in the transverse direction, i.e., 100 μm, 150 μm, 200 μm, 250 μm, 300 μm, and 350 μm. Table 10 shows the results. The total number of the active layers and inactive layers is in a range of three to six (four kinds), the thickness of the active layer or inactive layer is 10 μm, 15 μm and 20 μm (three kinds), and the number of the driving electrodes is in a range of one layer to three layers (at least a plurality of active layers or a plurality of inactive layers are included).

As can be seen from FIG. 10, the deformation efficiency is about 130 $pl^2/(nF \cdot mm^2)$ when the activation width is 100 μm, and increases as the activation width increases, up to the maximum value of about 500 $pl^2/(nF \cdot mm^2)$ when the width is 240 μm, and thereafter decreases to 350 μm as the activation width increases.

The result above indicates that the deformation efficient is improved from that of the first comparative example when the activation width is in the range of 100 μm (the ratio of the activation width to the pressure chamber width 350 μm is 100/350) to 350 μm (the ratio of the activation width to the pressure chamber width 350 μm is 350/350=1). From the viewpoint of obtaining further improved deformation efficiency, the activation width is preferably in the range of 140 μm (the above-mentioned ratio is 0.4) to 330 μm (the above-mentioned ratio is 0.94), more preferably in the range of 170 μm (the above-mentioned ratio is 0.49) to 300 μm (the above-mentioned ratio is 0.86), and most preferably in the range of 200 μm (the above-mentioned ratio is 0.57) to 270 μm (the above-mentioned ratio is 0.77). It should be noted that the width of the pressure chamber 10 is set to 0.1 mm≦L≦1 mm in the simulation.

As described above, according to the embodiment, the actuator unit is a unimorph type making use of piezoelectric transversal effect, and the actuator unit is capable of deforming by a relatively large amount in the direction in which the active and inactive layers are laminated. Therefore, volume of each pressure chamber can be changed by large amount, which allows the ink to eject sufficiently even if the pressure chamber is made smaller. Therefore, according to the embodiment, it becomes possible to arrange the pressure chambers at high density by decreasing the volume of the pressure chambers.

Further, according to the embodiment, the electrode which is farthest from the pressure chamber is formed to be the thinnest electrode to ensure a large displacement of the actuator unit. This configuration also allows to decrease the driving voltage. Furthermore, the effect of electrode potential on the ink is restrained to ensure normal operation of inkjet head.

Still further, a large displacement of the actuator unit is realized by making the thickness of the active layers to 20 μm or lower.

Further, according to the embodiment, a relatively large displacement of the actuator unit can be realized.

Further, according to the embodiment, the manufacturing process of the inkjet head can be simplified since the active and inactive layers are formed of the same material, and the layers have substantially the same thicknesses.

The present disclosure relates to the subject matter contained in Japanese Patent Application No. 2001-365497, filed on Nov. 30, 2001, which is expressly incorporated herein by reference in its entirety.

What is claimed is:

1. An inkjet head, comprising:

a plurality of pressure chambers, each of which being configured such that an end thereof is connected to a discharging nozzle and the other end is connected to an ink supplier; and an actuator unit for the plurality of pressure chambers, the actuator unit being a unimorph type actuator unit and being formed to be a continuous planar layer, said planar layer being arranged to cover said plurality of pressure chambers, said actuator unit including at least one inactive layer formed of piezoelectric material and arranged on a pressure chamber side, one of said at least one active layer being formed on a surface of the actuator unit that is proximal to the pressure chambers, said actuator unit having no inactive layer formed of piezoelectric material on a surface of the actuator unit that is distal from the pressure chambers, said actuator unit including at least one active layer formed of piezoelectric material and arranged on a side opposite to said pressure chamber side with respect to said inactive layer, said at least one active layer being sandwiched between a common electrode and a plurality of driving electrodes arranged at positions corresponding to said plurality of pressure chambers, said at least one active layer having a polarization direction substantially parallel with a thickness direction of said at least one active layer, said common electrode and said plurality of driving electrodes providing an electrical field in a direction substantially parallel with the polarization direction when the actuator unit is actuated, wherein said continuous planar layer includes a plurality of said at least one active layers and/or a plurality of said at least one inactive layers, and wherein one of said at least one active layer, having the polarization direction with which the direction of the electrical field is substantially parallel, is an immediate-neighboring piezoelectric layer to one of said at least one inactive layer.

2. The inkjet head according to claim 1, wherein when said driving electrodes is set to have potential different from the potential of said common electrode, said at least one active layer deforms in accordance with piezoelectric transverse effect, a unimorph effect being generated by the deformation of said active layers in association with said at least one inactive layer to vary a volume of each of said pressure chambers.

3. The inkjet head according to claim 2, wherein said common electrode is kept to a ground potential.

4. The inkjet head according to claim 1, wherein an electrode arranged farthest from said pressure chamber is configured to be the thinnest electrode among said common electrode and said plurality of driving electrodes.

5. The inkjet head according to claim 1, wherein an electrode closest to said pressure chambers is said common electrode.

6. The inkjet head according to claim 1, wherein a thickness of each of said at least one active layer is 20 $\mu$m or less.

7. The inkjet head according to claim 1, wherein the total number of said at least one active layer and said at least one inactive layer is four or more.

8. The inkjet head according to claim 1, wherein t/T is 0.8 or less, where t represents a thickness of said at least one active layer and T represents the entire thickness of said at least one active layer and said at least one inactive layer.

9. The inkjet head according to claim 8, wherein t/T is 0.7 or less.

10. The inkjet head according to claim 1, wherein conditions:

$$0.1\ \text{mm} \leqq L \leqq 1\ \text{mm, and}$$

$$0.3 \leqq \delta/L \leqq 1,$$

are satisfied, wherein L represents a length of each of said pressure chambers in the transverse direction, and wherein $\delta$ represents a length of each of said driving electrodes in a direction similar to the length L of each of said pressure chambers.

11. The inkjet head according to claim 1, wherein all of said at least one active layer and said at least one inactive layer are formed of the same material.

12. The inkjet head according to claim 1, wherein all of said at least one active layer and said at least one inactive layer have substantially the same thickness.

13. The inkjet head according to claim 1, wherein the number of the active layers and the number of the inactive layers are two and one, respectively.

14. The inkjet head according to claim 1, wherein the number of said active layers and the number of said inactive layers are two and two, respectively.

15. The inkjet head according to claim 1, wherein the total number of said active layers and said inactive layers is five, the number of one of said active layers and inactive layers being three.

16. The inkjet head according to claim 1, wherein the number of said active layers and the number of said inactive layers are the same.

17. The inkjet head according to claim 1, wherein a difference between the number of said active layers and the number of said inactive layers is one.

18. The inkjet head according to claim 1, wherein said common electrode is kept to a ground potential.

19. The inkjet head according to claim 1, wherein, when the actuator unit is actuated, the at least one active layer contracts in a direction perpendicular to a thickness direction of the at least one active layer.

20. The inkjet head according to claim 1, wherein said continuous planar layer includes a plurality of said at least one active layers, and all of the plurality of active layers contract or expand in a same direction when the electrical field is provided.

21. The inkjet head according to claim 1, wherein said continuous planar layer includes a plurality of said at least one inactive layers, and the plurality of inactive layers are adjacently laminated to each other and arranged between said at least one active layer and the pressure chambers.

* * * * *